United States Patent [19]

Fjällström et al.

[11] 4,155,239

[45] May 22, 1979

[54] TUBE BENDING APPARATUS

[75] Inventors: Bengt Fjällström; John Close, both of Tidaholm, Sweden

[73] Assignee: Arenco Parts, AB, Tidaholm, Sweden

[21] Appl. No.: 794,454

[22] Filed: May 6, 1977

[30] Foreign Application Priority Data

May 6, 1976 [SE] Sweden ..... 7605176

[51] Int. Cl.[2] ..... B21D 11/06

[52] U.S. Cl. ..... 72/218; 72/135

[58] Field of Search ..... 72/216, 217, 218, 142, 72/153, 159, 310, 319, 320, 321, 322, 387, 388, 458, 135, 146

[56] References Cited

U.S. PATENT DOCUMENTS 2,413,523 12/1946 Shaw, Jr. ..... 72/319

3,742,749 7/1973 Bondarenko ..... 72/217

FOREIGN PATENT DOCUMENTS 685131 4/1964 Canada ..... 72/459

905 of 1907 United Kingdom ..... 72/217

*Primary Examiner*—Michael J. Keenan

*Attorney, Agent, or Firm*—Cushman, Darby & Cushman

[57] ABSTRACT

An apparatus for bending tubes into three-dimensional helices or coils comprises means for intermittent clamping of the tube, a first substantially stationary shaping member having a groove, which extends in an arc of at least approximately 180° and defines a first substantially plane surface, as well as a rotatable shaping roller whose rotational axis is movable substantially along a circular arc for performing the tube bending operation. Said shaping roller has an endless, circumferential groove, which has substantially the same cross sectional shape as that of the stationary shaping member and half of the cross section of the tube and defines a second substantially plane surface. Said shaping roller is displaceable with respect to the stationary shaping member substantially perpendicularly to the second plane surface which forms an obtuse angle with the first substantially plane surface.

6 Claims, 2 Drawing Figures

TUBE BENDING APPARATUS

BACKGROUND OF THE INVENTION

The invention generally relates to an apparatus for bending tubes into three-dimensional helices or coils, comprising means for intermittent clamping of the tube, which is intermittently displaceable in its longitudinal direction between successive clamping operations; a first substantially stationary shaping member having a groove, which extends in an arc of at least approximately 180° and whose cross section substantially conforms to half of the cross section of the tube to be bent, the locus of the most deeply located points of the bottom of the groove defining a first substantially plane surface; a movable bending member having a rotatable shaping roller which has an endless, circumferential groove of substantially the same cross sectional shape as that of the stationary shaping member and whose rotational axis is movable substantially along a circular arc, which comprises at least approximately 180° and whose center approximately coincides with the center of the first-mentioned arc, the locus of the most deeply located points of the bottom of the groove of the shaping roller defining a second substantially plane surface.

The principal object of the invention is to provide a tube bending apparatus of the above kind which substantially automatically and successively bends a numer of tubes into an equal number of preferably flattened, three-dimensional helices or coils.

SUMMARY OF THE INVENTION

This object is attained thanks to the fact that said shaping roller is displaceable with respect to the stationary shaping member substantially perpendicularly to the second plane surface, which forms an obtuse angle with the first substantially plane surface.

BRIEF DESCRIPTION OF THE DRAWINGS

Further features and advantages will become apparent from the following detailed description and the annexed drawings, which diagrammatically and as non-limiting example illustrate an embodiment of the invention, which is preferred at present.

DESCRIPTION OF THE PREFERRED EMBODIMENT

Figure 1:
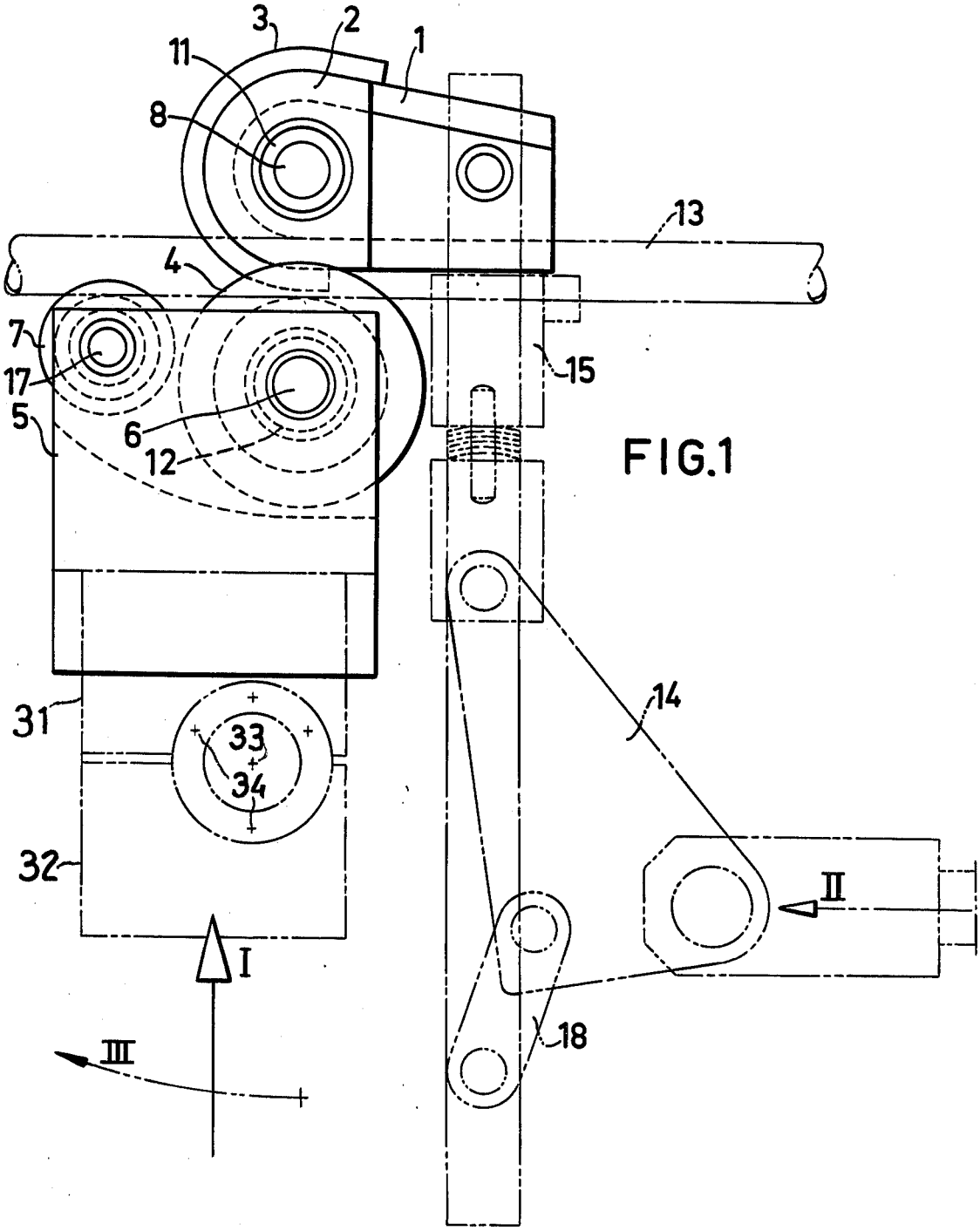
FIG. 1 is a front elevational view illustrating the principal parts of the tube bending apparatus according to the invention.

The tube bending apparatus according to the invention comprises a stationary guide and clamping member 1 which on its underside has a groove for guiding the tube 13 and having a cross section, which substantially conforms to half of the cross section of the tube. To this member there is rigidly secured a guide member 3 which has a substantially helically extending guiding groove 20 (FIG. 2). Behind member 1, as seen in the direction of travel of the tube 13, which is intermittently advanced to the left in FIG. 1 between successive bending operations, a substantially stationary shaping member 2 is provided right opposite to the guide member 3. The guide member 3 cooperates with a pivotable bending member in the shape of a block 5 in which two wheels or rollers 4 and 7 are rotatably journalled on shafts or axles 6 and 17 respectively. Through the intermediary of the block 5 the rollers 4 and 7 may be pressed against the underside of the tube 13 under the influence of a force I, and in addition hereto the block 5 may, together with the rollers 7 and 4, be pivoted upwards in the clockwise direction at least about 180° with the center axis 8 of the shaping member 2 as the pivot axis, under the influence of a torque or moment of rotation as indicated by the arrow III. The block 5 is secured in a pair of fastening means 31, 32 which may be displaced in the longitudinal direction of the tube 13. Accordingly, the block 5 may be displaced in the longitudinal direction of the tube 13 with respect to a pair of fastening means 31, 32 as well as rotated on the axis 33, by loosening diagramatically indicated threaded bolts 34 or the like, adjusting the position of the block 5 in relation to the fastening means 31, 32, and retightening the bolts 34. In this way the location and the exact direction of the force I acting upon the block 5 may be altered, if need should arise.

The apparatus also comprises a locking head 15, which by means of a linkage 14, 18 is adapted to press the tube 13 against the guiding and fastening member 1 through the action of the force II during the tube bending operations.

The substantially stationary shaping member 2 has a circumferential groove 21 comprising an arc of at least about 180° and having a cross sectional shape, which substantially conforms to half of the cross section of the tube 13. To impart the desired pitch (between adjacent turns) to the three-dimensional tube coil being manufactured of the tube 13 the groove 21 extends along part of a helix. This means that the locus of the most deeply located points of the bottom of the groove 21 can be considered to define a substantially plane surface. The shaping member 2 is secured to a shaft or an axle 8, which is substantially parallel to the axis of rotation 6 of the wheel or roller 4. For reasons which are apparent from the following the shaping member 2 is, together with its axle 8 which is biased by a spring 9, reversibly movable within narrow limits in the axial direction, as is indicated by the doubleheaded arrow 22, and in addition hereto the shaping member 2 is universally journalled on the axle 8 by means of a spherical bearing 11. Thus, the shaping member 2 can tilt clockwise through the angle $\alpha$ from the initial position shown in FIG. 2.

The shaping roller 4 also has a circumferentially extending groove 23 the cross section of which, like that of groove 21, approximately conforms to half of the cross sectional area of the tube 13.

The deepest (with respect to the groove itself) located points of the bottom of the groove 23 define a second substantially plane surface (as a matter of fact a plane) which is perpendicular to the axle 6 and accordingly forms an obtuse angle with the first substantially plane surface. The wheel or roller 4 also has a flange 24, which is in engagement with and guided by the guiding groove 20 of the guide member 3 during the bending operation. In addition hereto the shaping roller 4 is together with its axle 6 axially displaceable to the right in FIG. 2 against the action of a spring 10. Finally the shaping roller 4 is universally journalled on its axle 6 by means of a spherical bearing 12. This permits the roller 4 to tilt through the angle $\alpha'/2$ in all directions.

The bending of a three-dimensional helix or coil with longish turns in the apparatus according to the invention is carried out in the following way.

Initially, the tube 13 to be bent is advanced to the left between the shaping member 2 and the rollers 7, 4 so far that a tube coil portion bent through 180°, plus a straight tube portion of a predetermined length, will be located to the left of a vertical plane through the center lines of the axles 6 and 8. The tube 13 is then clamped between the stationary clamping member 1 and the clamping head 15 by actuating the linkage 14, 18 through the force II. After that the block 5 with the roller 4, 7 is pivoted upwards about 180° in the clockwise direction under the influence of the torque III. Hereby the roller 7 presses the tube forwards ahead of itself, so that the tube during this movement is formed into a helical arc or bend of 180° by the roller 4, which presses the tube 13 against the shaping member 2 under the influence of the force I. During this bending operation the roller 4 is displaced together with its axle 6 to the right in FIG. 2 in the direction of the axle, due to the fact that the flange 24 follows the groove 20 in the guide member 3 while overcoming the force of the spring 10. Simultanously the roller 4 is tilted a little on an axis which is substantially perpendicular to the plane of FIG. 2, so that the force acting upon the tube 13 from the roller 4 remains substantially radial with respect to the tube.

In the next operational step the force 1 is (automatically) removed and the block 5 pivoted counter-clockwise back to its initial position. After that the tube, to which a first 180° bend has just been imparted, is anew advanced a distance to the left which corresponds to an 180° bend plus a straight longitudinal side or portion of the three-dimensional tube coil or helix being manufactured. After that, the bending operation just described in repeated, the first turn of the three-dimensional tube coil being completed and the first 180° bend getting into a position to the right of the shaping member 2 in FIG. 1.

Figure 2:
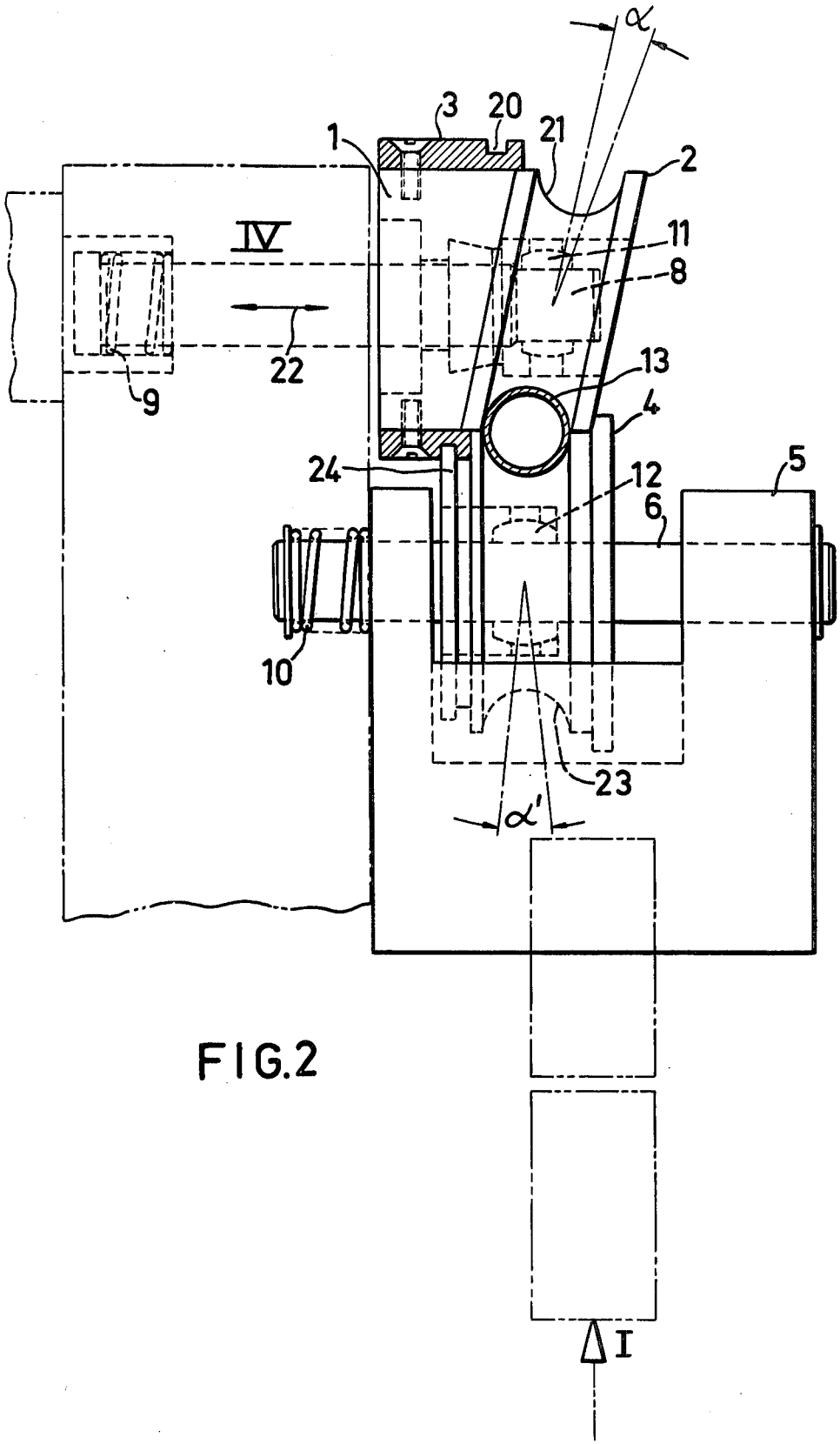
FIG. 2 is an end view, partly in section, of the tube bending apparatus as seen from the left in FIG. 1.

Due to the fact that the advancement of the tube 13 between successive bending operations is longer than a complete longish turn of the three-dimensional tube coil or helix, it is necessary that the tube bend in question during the subsequent tube advancement step passes the shaping member 2 during its movement to the left in FIG. 1. This is accomplished thanks to the fact that the shaping member 2 during the advancement of the tube 13 is tilted upon, and axially displaced together with, the axle 8, the shaping member 2 being guided by the engagement of its groove 21 with upper and lower portions, respectively, of adjacent turns of the coil being manufactured. During the tube advancement step the engagement between the tube coil and the shaping member 2 ceases, which then recoils to a position in which it admits the rear bend of the tube coil to pass.

The bending operation above described is then continued until the complete tube has become bent into the predetermined number of turns and the three-dimensional tube coil or helix is finished. At the last tube advancement step the completed tube coil is ejected from the tube bending apparatus.

The embodiment described above and illustrated in the drawings is, of course, to be regarded merely as non-limiting example and can as to its details be modified in several ways within the scope of the following claims.

What we claim is:

1. A machine for bending tubes into three-dimensional helices or coils, comprising means for intermittent clamping of the tube ; a first shaping member having a groove which extends in an arc of at least approximately 180° and whose cross section substantially comforms to half of the cross section of the tube to be bent, the locus of the most deeply located points of the bottom of the groove defining a first substantially plane surface; a movable bending member having a rotatable shaping roller which hs an endless, circumferential groove of substantially the same cross sectional shape as that of the shaping member and whose rotational axis is movable substantially along a circular arc which comprises at least approximately 180° and whose center approximately coincides with the center of the first mentioned arc, the locus of the most deeply located points of the bottom of the groove of the shaping roller defining a second substantially plane surface, and said shaping roller being displaceable with respect to the stationary shaping member substantially perpendicularly to the second plane surface which forms an obtuse angle with the first substantially plane surface, wherein the angle between said two surfaces is variable.

2. A machine according to claim 1, wherein said shaping roller is displaceable together with its axle of rotation.

3. A machine according to claim 1, wherein said shaping roller is universially movable.

4. A machine according to claim 1, wherein said shaping member is universially movable.

5. A machine according to claim 1, wherein said shaping member is displaceable substantially perpendicularly to said second plane surface.

6. Method of bending a tube into a three-dimensional helix or coil, comprising the steps of:

(A) clamping the tube between clamping jaws in such a manner that a predetermined portion of the tube projects forwardly of said jaws;

(B) bending through an arc of substantially 180° that part of the projecting portion, which is located nearest to the clamping jaws around a first shaping member having a circumferential, arcuate groove, which extends in a substantially helical path, in such a way that the straight fore end of the tube extends away from the 180° bend just formed and from said clamping jaws;

(C) releasing the tube from the grip of said clamping jaws;

(D) advancing the tube substantially parallel to the rear, unbent portion of the tube through a distance which substantially equals at least part of the straight fore end of the tube plus the 180° bend just formed;

(E) clamping the tube anew between said clamping jaws;

(F) repeating the tube bending, tube releasing, tube advancing and tube clamping steps (B)–(E) sequentially and cyclically, terminating with the tube bending and tube releasing steps (B) and (C) until a three-dimensional coil comprising a succession of 180° tube bends interconnected with each other by straight, substantially parallel tube portions of equal length joining adjacent tube bends is formed; and (G) ejecting the finished tube coil from said clamping jaws.

* * * * *